US010618307B2

(12) United States Patent
Tatsuta et al.

(10) Patent No.: US 10,618,307 B2
(45) Date of Patent: Apr. 14, 2020

(54) LIQUID EJECTING APPARATUS AND DRIVING METHOD OF LIQUID EJECTING APPARATUS

(71) Applicant: SEIKO EPSON CORPORATION, Tokyo (JP)

(72) Inventors: Daiki Tatsuta, Matsumoto (JP); Ryoji Fujimori, Suwa (JP); Kaoru Koike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/865,876

(22) Filed: Jan. 9, 2018

(65) Prior Publication Data

US 2018/0207944 A1 Jul. 26, 2018

(30) Foreign Application Priority Data

Jan. 20, 2017 (JP) ..... 2017-008896

(51) Int. Cl.
*B41J 2/19* (2006.01)
*B41J 2/175* (2006.01)

(52) U.S. Cl.
CPC *B41J 2/19* (2013.01); *B41J 2/175* (2013.01)

(58) Field of Classification Search
CPC ..... B41J 2/19
See application file for complete search history.

(56) References Cited

U.S. PATENT DOCUMENTS

2008/0079792 A1* 4/2008 Hirato ..... B41J 2/175 347/92
2010/0053283 A1 3/2010 Ito
2010/0053286 A1* 3/2010 Ito ..... B41J 2/17509 347/93
2010/0231668 A1* 9/2010 Ito ..... B41J 2/175 347/92
2015/0224786 A1* 8/2015 Otsuka ..... B41J 2/17596 347/92
2017/0217176 A1* 8/2017 Sato ..... B41J 2/04581
2017/0217197 A1* 8/2017 Kanegae ..... B41J 2/17563
2017/0239956 A1* 8/2017 Karita ..... B41J 2/175

FOREIGN PATENT DOCUMENTS

JP 2010-052320 A 3/2010

* cited by examiner

*Primary Examiner* — Shelby L Fidler
(74) *Attorney, Agent, or Firm* — Workman Nydegger

(57) ABSTRACT

A liquid ejecting apparatus includes a liquid flow path which communicates with a nozzle which ejects liquid; a vacuum degassing chamber for removing air bubbles from liquid by depressurizing a part of the liquid flow path; a gas flow path which communicates with the vacuum degassing chamber; a pressurizing chamber which communicates with the gas flow path; and a pump which communicates with the vacuum degassing chamber and the pressurizing chamber through the gas flow path, in which the pump is driven by a sequence selected from a plurality of sequences, and the plurality of sequences include a plurality of depressurizing sequences in which the vacuum degassing chamber is depressurized so that an average pressure of the vacuum degassing chamber becomes different, and a pressurizing sequence in which the pressurizing chamber is pressurized.

10 Claims, 6 Drawing Sheets

LIQUID EJECTING APPARATUS AND DRIVING METHOD OF LIQUID EJECTING APPARATUS

CROSS-REFERENCE TO RELATED APPLICATIONS

The present application claims priority to Japanese Patent Application No. 2017-008896, filed Jan. 20, 2017, which is hereby incorporated by reference in its entirety.

BACKGROUND

1. Technical Field

The present invention relates to a technology for ejecting liquid such as ink.

2. Related Art

In a liquid ejecting apparatus which ejects liquid such as ink from a nozzle, there is a case in which a gas flow path such as a valve through which gas for driving is caused to flow is provided, in addition to a liquid flow path through which liquid is caused to flow, and the gas flow path is used as a pressurizing chamber and a depressurizing chamber. For example, in JP-A-2010-052320, a vacuum degassing chamber which removes air bubbles by depressurizing the liquid flow path, a pressurizing chamber in which a diaphragm is provided, and the gas flow path which communicates with the pressurizing chamber and the vacuum degassing chamber (depressurizing chamber). Since the gas flow path communicates with a pump, when the gas flow path is depressurized by the pump, the vacuum degassing chamber is depressurized, and it is possible to remove air bubbles from liquid which flows in the liquid flow path. In addition, when pressurizing the gas flow path using a pump, the pressurizing chamber is pressurized, and the diaphragm can be driven.

In the configuration in which the gas flow path is used as the pressurizing chamber and the vacuum degassing chamber, as in JP-A-2010-052320, there is a case in which the gas flow path is switched from a depressurized state to a pressurized state. However, when the gas flow path is transferred from a depressurized state to a pressurized state, there is a problem in that, the lower the pressure in depressurizing, it takes time in transferring from a depressurized state to a pressurized state, and a response of a pressure change decreases.

SUMMARY

An advantage of some aspects of the invention is to improve a response of a pressure change when the gas flow path is transferred from a depressurized state to pressurized state.

Aspect 1

A liquid ejecting apparatus according to an aspect (aspect 1) of the invention includes a liquid flow path which communicates with a nozzle which ejects liquid; a vacuum degassing chamber for removing air bubbles from liquid by depressurizing a part of the liquid flow path; a gas flow path which communicates with the vacuum degassing chamber; a pressurizing chamber which communicates with the gas flow path; and a pump which communicates with the vacuum degassing chamber and the pressurizing chamber through the gas flow path, in which the pump is driven by a sequence selected from a plurality of sequences, and the plurality of sequences include a plurality of depressurizing sequences in which the vacuum degassing chamber is depressurized so that an average pressure of the vacuum degassing chamber is different, and a pressurizing sequence in which the pressurizing chamber is pressurized. In this configuration, it is possible to change an average pressure of the vacuum degassing chamber by driving the pump by changing a sequence to be selected from the plurality of depressurizing sequences. Accordingly, since it is possible to switch from a depressurizing sequence in which the average pressure of the vacuum degassing chamber is high to the pressurizing sequence, it is possible to perform pressurizing from a depressurized state in which a pressure of the gas flow path is high. In this manner, it is possible to improve a response of a pressure change when the gas flow path is transferred from a depressurized state to a pressurized state. In addition, since a driving time of the pump is changed, and it is possible to change an average pressure of the vacuum degassing chamber by selecting a depressurizing sequence, a lifespan of the pump can be lengthened.

Aspect 2

A liquid ejecting apparatus according to another aspect (aspect 2) of the invention includes a liquid flow path which communicates with a nozzle which ejects liquid; a vacuum degassing chamber for removing air bubbles from liquid by depressurizing a part of the liquid flow path; a gas flow path which communicates with the vacuum degassing chamber; a pressurizing chamber which communicates with the gas flow path; and a pump which communicates with the gas flow path, in which the pump is driven by a sequence which is selected from a plurality of sequences, and the plurality of sequences include a plurality of depressurizing sequences in which the vacuum degassing chamber is depressurized so that a power consumption of the pump becomes different, and a pressurizing sequence in which the pressurizing chamber is pressurized. In this configuration, it is possible to change an amount of power consumption of the pump by driving the pump by changing a sequence to be selected from the plurality of depressurizing sequences. It is also possible to change an average pressure of a vacuum degassing chamber Q by changing the amount of power consumption of the pump. Accordingly, it is possible to perform pressurizing in a depressurized state in which a pressure of the gas flow path is high, by switching from the depressurizing sequence in which the amount of power consumption of the pump is low to the pressurizing sequence. In this manner, it is possible to improve a response of a pressure change when the gas flow path is transferred from a depressurized state to a pressurized state. In addition, since it is possible to change an amount of power consumption of the pump by selecting the depressurizing sequence, a lifespan of the pump can be lengthened.

Aspect 3

In a preferable aspect (aspect 3) of the aspect 1 or 2, in the plurality of depressurizing sequences, a reaching pressure as a target of the vacuum degassing chamber using the pump may be different. In this configuration, it is possible to change the reaching pressures as a target of the vacuum degassing chamber, by driving the pump by changing a sequence to be selected from the plurality of depressurizing sequences. Accordingly, by selecting a depressurizing sequence in which with a reaching pressure is low, it is possible to increase a discharging speed of air bubbles. On the other hands, when selecting a depressurizing sequence in which a reaching pressure is high, it is possible to lengthen a lifespan of the pump.

Aspect 4

In a preferable aspect (aspect 4) of any one of the aspects 1 to 3, driving cycles of the pump may be different in the plurality of depressurizing sequences. In this configuration, it is possible to change a driving cycle of the pump by driving the pump by changing a sequence to be selected from the plurality of depressurizing sequences. It is possible to change an average pressure of the vacuum degassing chamber by changing the driving cycle of the pump. Accordingly, since it is possible to switch from a depressurizing sequence in which the average pressure of the vacuum degassing chamber is high to the pressurizing sequence, it is possible to improve a response of a pressure change when the gas flow path is transferred from a depressurized state to a pressurized state. In addition, it is also possible to change an amount of power consumption of the pump by changing a driving cycle of the pump. The shorter the driving cycle of the pump, it is possible to realize a target average pressure, even when a reaching pressure of the vacuum degassing chamber is high. For this reason, since it is possible to reduce a pressure resistance of a flow path structure of the pump or the liquid ejecting apparatus, the structure of the flow path can be made simple.

Aspect 5

In a preferable aspect (aspect 5) of any one of the aspects 1 to 4, the pressurizing chamber may be provided with a flexible film which bends due to pressurizing by the pressurizing sequence, and the plurality of depressurizing sequences may be selected according to a timing of pressurizing the flexible film. In this configuration, it is possible to separately use the depressurizing sequence according to a timing of pressurizing the flexible film. Accordingly, in a case in which the flexible film is not pressurized, for example, it is possible to increase a degassing speed by selecting the depressurizing sequence in which a pressure of the gas flow path is low. In addition, at a timing of pressurizing the flexible film, it is possible to increase a response of the flexible film when transferring to a pressurized state to a depressurized state, by selecting the depressurizing sequence in which a pressure of the gas flow path is high, before executing the pressurizing sequence.

Aspect 6

In a preferable aspect (aspect 6) of any one of the aspects 1 to 5, the plurality of depressurizing sequences may be selected according to an amount of air bubbles in the liquid flow path. In this configuration, since the plurality of depressurizing sequences are selected according to the amount of air bubbles in the liquid flow path, and it is possible to suppress a power consumption of the pump by selecting the depressurizing sequence in which a pressure of the gas flow path is high, when an amount of air bubbles in the liquid flow path is a predetermined amount or less, it is possible to lengthen a lifespan of the pump. In addition, when an amount of air bubbles in the liquid flow path exceeds a predetermined amount, it is possible to increase a discharging speed of air bubbles, when there are many air bubbles such as an initial filling time of liquid, for example, by selecting the depressurizing sequence in which a pressure of the gas flow path is low.

Aspect 7

In a preferable aspect (aspect 7) of any one of the aspects 1 to 6, the plurality of depressurizing sequences may be selected according to a driving time of the pump. In the configuration, since the plurality of depressurizing sequences are selected according to a driving time of the pump, it is possible to lengthen a lifespan of the pump by selecting the depressurizing sequence in which a pressure of the gas flow path is low when a driving time of the pump is a predetermined time or less, and selecting the depressurizing sequence in which a pressure of the gas flow path is high, when a driving time of the pump exceeds the predetermined time.

Aspect 8

In a preferable aspect (aspect 8) of any one of the aspects 1 to 7, liquid may be discharged from a nozzle by reducing a volume of the liquid flow path, by bending the flexible film of the pressurizing chamber using the pressurizing sequence. In this configuration, since liquid is discharged from a nozzle by reducing a volume of the liquid flow path, by bending the flexible film of the pressurizing chamber using the pressurizing sequence, it is possible to discharge thickened liquid from the nozzle using the pressurizing sequence. At this time, since it is possible to improve a response of the flexible film by switching from the depressurizing sequence in which a pressure of the gas flow path is high to the pressurizing sequence, it is possible to increase an efficiency of discharging thickened liquid from the nozzle.

Aspect 9

According to still another aspect (aspect 9) of the invention, there is provided a driving method of a liquid ejecting apparatus which includes a liquid flow path which communicates with a nozzle which ejects liquid; a vacuum degassing chamber for removing air bubbles from liquid by depressurizing a part of the liquid flow path; a gas flow path which communicates with the vacuum degassing chamber; a pressurizing chamber which communicates with the gas flow path; and a pump which communicates with the gas flow path, the method including driving the pump using a depressurizing sequence selected from a plurality of depressurizing sequences which depressurize the vacuum degassing chamber so that an average pressure of the vacuum degassing chamber becomes different, and a pressurizing sequence in which the pressurizing chamber is pressurized. In this configuration, it is possible to change the average pressure of the vacuum degassing chamber by driving the pump by changing a sequence to be selected from the plurality of depressurizing sequences. Accordingly, when the pump is driven by the depressurizing sequence in which the average pressure of the vacuum degassing chamber is high, since it is possible to perform pressurizing from the depressurizing state in which a pressure of the gas flow path is high, by switching from the depressurizing sequence to the pressurizing sequence, it is possible to improve a response of a pressure change when the gas flow path is transferred from a depressurized state to a pressurized state.

Aspect 10

In a preferable aspect (aspect 10) of the aspect 9, the plurality of depressurizing sequences include a first depressurizing sequence and a second depressurizing sequence, in the second depressurizing sequence, an average pressure of the vacuum degassing chamber is higher than that in the first depressurizing sequence, and switching is performed from the second depressurizing sequence to the pressurizing sequence. In this configuration, since switching is performed from the second depressurizing sequence in which the average pressure of the vacuum degassing chamber is high to the pressurizing sequence, it is possible to perform pressurizing from a depressurized state in which a pressure of the gas flow path is high, and accordingly, it is possible to improve a response of a pressure change when the gas flow path is transferred from a depressurized state to a pressurized state. In addition, it is possible to increase a discharging speed of air bubbles in the vacuum degassing chamber by selecting the first depressurizing sequence in which the average pressure of the vacuum degassing chamber is low.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
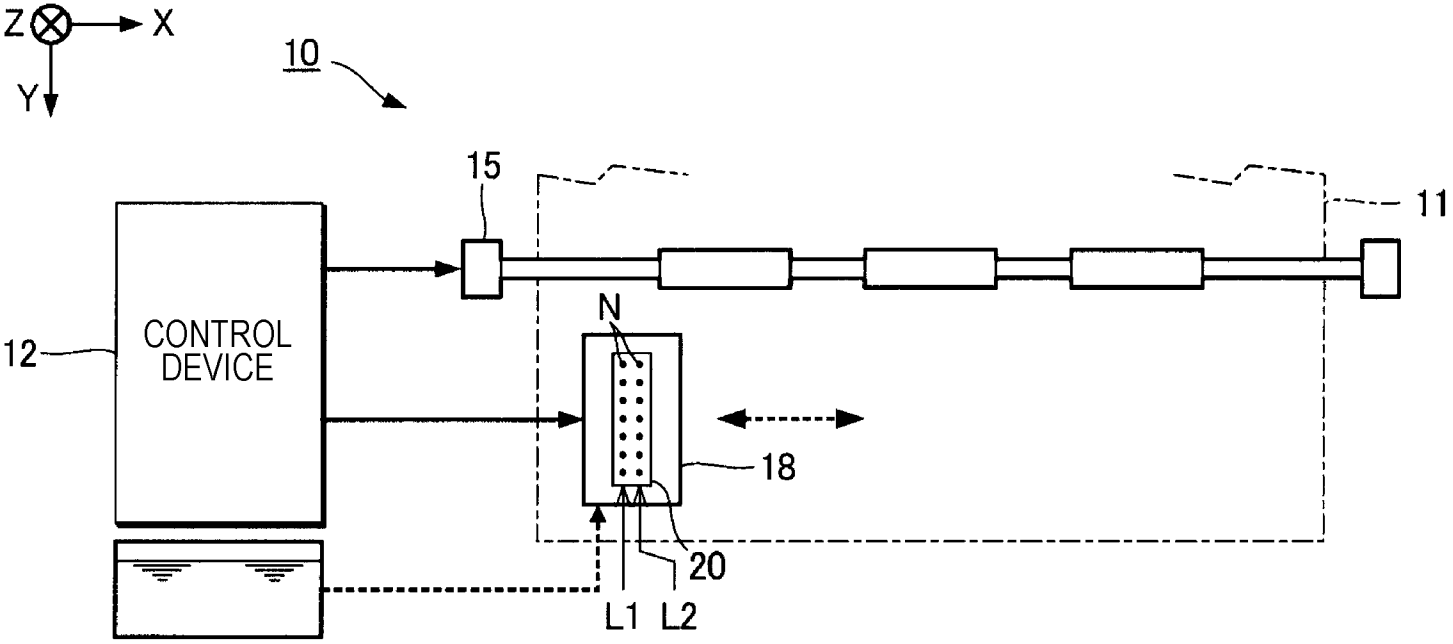
FIG. 1 is a configuration diagram of a liquid ejecting apparatus according to a first embodiment of the invention.

FIG. 1 is a partial configuration diagram of a liquid ejecting apparatus 10 according to the first embodiment of the invention. The liquid ejecting apparatus 10 according to the first embodiment is an ink jet printer which ejects ink as an example of liquid to a medium 11 such as a printing sheet. The liquid ejecting apparatus 10 illustrated in FIG. 1 is provided with a control device 12, a transport mechanism 15, a carriage 18, and a liquid ejecting head 20. A liquid container 14 for storing ink is mounted on the liquid ejecting apparatus 10.

The liquid container 14 is a cartridge of an ink tank type which is formed of a box-shaped container, and is detachably attached to a main body of the liquid ejecting apparatus 10. The liquid container 14 is not limited to the box-shaped container, and may be an ink pack-type cartridge which is configured of a bag-shaped container. Ink is stored in the liquid container 14. Ink may be black ink or a color ink. The ink stored in the liquid container 14 is sent to the liquid ejecting head 20 by being pressurized.

The control device 12 integrally controls each element of the liquid ejecting apparatus 10. The transport mechanism 15 transports the medium 11 in the Y direction under a control of the control device 12. The liquid ejecting head 20 ejects ink supplied from the liquid container 14 to the medium 11 from each of the plurality of nozzles N under a control of the control device 12.

The liquid ejecting head 20 is mounted on the carriage 18. In FIG. 1, a case in which one liquid ejecting head 20 is mounted on the carriage 18 is exemplified; however, it is not limited to this, and a plurality of the liquid ejecting heads 20 may be mounted on the carriage 18. The control device 12 causes the carriage 18 to reciprocate in the X direction which intersects (orthogonal in FIG. 1) the Y direction. A desired image is formed on the surface of the medium 11 when the liquid ejecting head 20 ejects ink onto the medium 11 in parallel with transporting of the medium 11 and reciprocating of the carriage 18. In addition, the plurality of liquid ejecting heads 20 may be mounted on the carriage 18. A direction perpendicular to an X-Y plane (plane parallel to surface of medium 11) is denoted by a Z direction.

Figure 2:
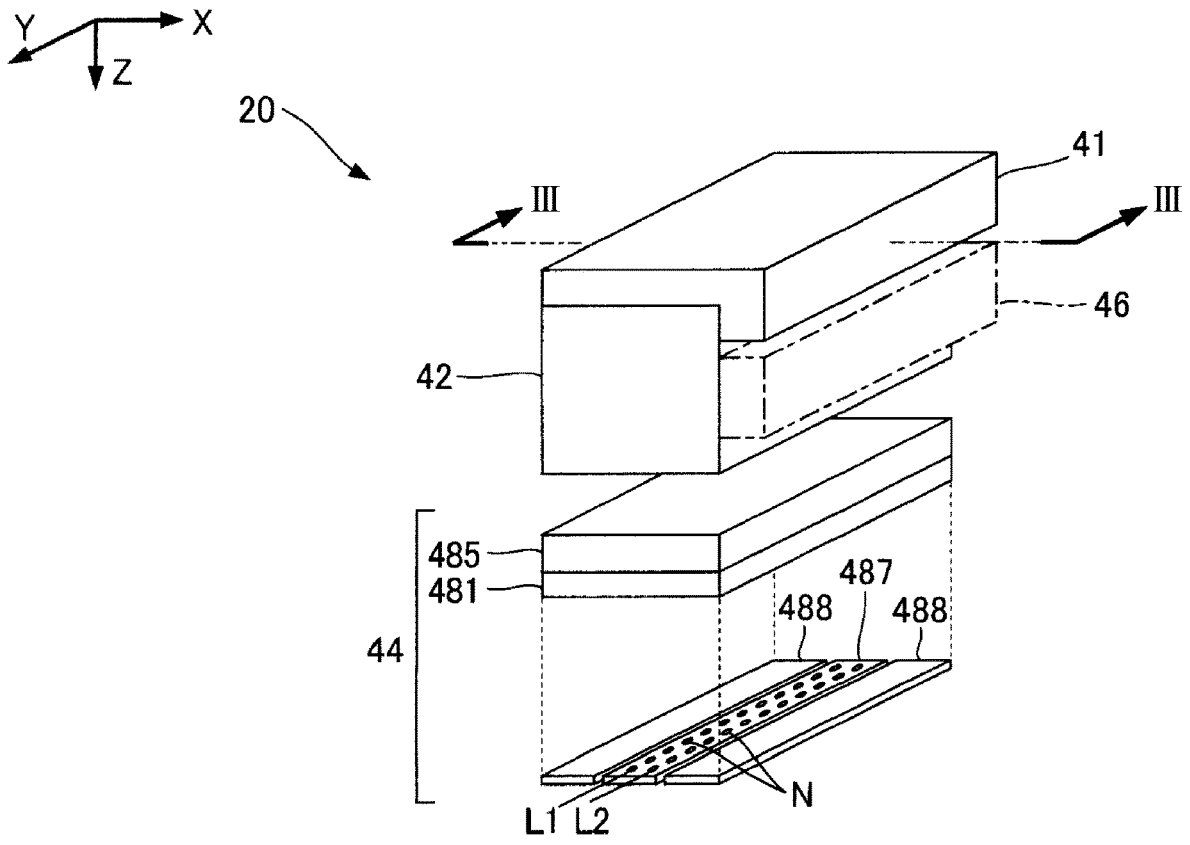
FIG. 2 is an exploded perspective view of a liquid ejecting head.
Figure 3:
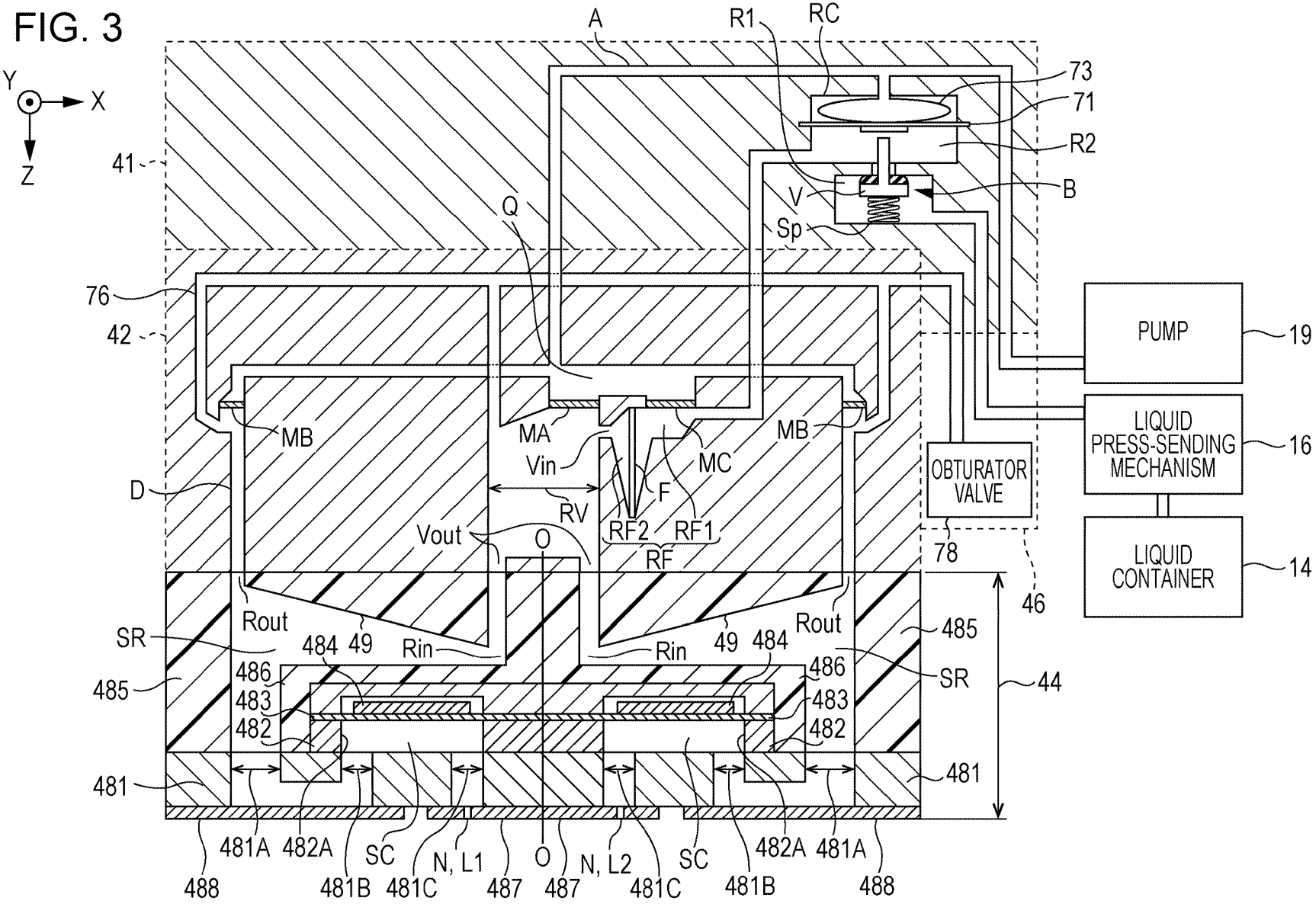
FIG. 3 is a sectional view which is taken along line III-III of the liquid ejecting head illustrated in FIG. 2.

FIG. 2 is an exploded perspective view of the liquid ejecting head 20. FIG. 3 is a sectional view which is taken along line III-III of the liquid ejecting head 20 illustrated in FIG. 2. As illustrated in FIGS. 2 and 3, the liquid ejecting head 20 is provided with a valve mechanism unit 41, a flow path unit 42, a liquid ejecting unit 44 and a flow path component 46. The liquid ejecting unit 44 ejects ink from the plurality of nozzles N. The flow path unit 42 is a structure body in which a liquid flow path D through which ink passes through the valve mechanism unit 41 is supplied to the liquid ejecting unit 44 is formed inside. The liquid ejecting unit 44 ejects ink supplied through the flow path component 46 and the flow path unit 42 from the liquid container 14 onto the medium 11. The valve mechanism unit 41 includes an on-off valve B, which will be described later, which controls opening and closing of the liquid flow path D of ink supplied from the flow path component 46. The valve mechanism unit 41 is provided in the flow path unit 42 so as to expand in the X direction from a side face thereof. On the other hand, the flow path component 46 is provided so as to face a side face of the flow path unit 42. A top face of the flow path component 46 and a lower face of the valve mechanism unit 41 faces with an interval in the Z direction each other. The liquid flow path D in the flow path component 46 and the liquid flow path D in the valve mechanism unit 41 communicate with each other.

The liquid ejecting unit 44 is a structure body in which a pressure chamber substrate 482, a vibrating plate 483, a piezoelectric element 484, a housing unit 485, and a sealing body 486 are disposed on one side of the flow path substrate 481, and a nozzle plate 487 and a buffering plate 488 are disposed on the other side. The flow path substrate 481, the pressure chamber substrate 482, and the nozzle plate 487 are formed of a silicon flat plate member, for example, and the housing unit 485 is formed, using injection molding of a resin material, for example. The plurality of nozzles N are formed in the nozzle plate 487. In the nozzle plate 487, a surface on a side opposite to the flow path substrate 481 corresponds to an ejecting face (face facing medium 11 in liquid ejecting unit 44).

The plurality of nozzles N are classified into a first nozzle column L1 and a second nozzle column L2. Each of the first nozzle column L1 and the second nozzle column L2 is aggregation of the plurality of nozzles N which are arranged along the Y direction. The first nozzle column L1 and the second nozzle column L2 align in the X direction with an interval each other. In addition, it is also possible to make a position of each nozzle N of the first nozzle column L1 and a position of each nozzle N of the second nozzle column L2 in the Y direction different from each other (so-called arrangement in zigzag or staggered arrangement).

As illustrated in FIG. 3, in the liquid ejecting unit 44 in the embodiment, a structure corresponding to the first nozzle column L1 (left portion in FIG. 3) and a structure corresponding to the second nozzle column L2 (right portion in FIG. 3) are formed in linearly symmetric, approximately, with a virtual line O-O in the X direction, and both of the structures are practically common. For this reason, hereinafter, a structure corresponding to the first nozzle column L1 (left portion of virtual line O-O in FIG. 3) will be mainly described.

An opening portion 481A, a branching flow path (diaphragm flow path) 481B, and a communicating flow path 481C are formed in the flow path substrate 481. The branching flow path 481B and the communicating flow path 481C are through-holes which are formed in each nozzle N, and the opening portion 481A is an opening which is continuous over the plurality of nozzles N. The buffering plate 488 is a flat plate member (compliance substrate) which closes the opening portion 481A which is provided on the surface on a side opposite to the pressure chamber substrate 482 in the flow path substrate 481. A pressure change in the opening portion 481A is absorbed by the buffering plate 488.

A common liquid chamber (reservoir) SR which communicates with the opening portion 481A of the flow path substrate 481 is formed in the housing unit 485. The common liquid chamber SR on the left side in FIG. 3 is a space for storing ink supplied to the plurality of nozzles N which configure the first nozzle column L1, and is continuous over the plurality of nozzles N. The common liquid chamber SR on the right side in FIG. 3 is a space for storing ink supplied to the plurality of nozzles N which configure the second nozzle column L2, and is continuous over the plurality of nozzles N. An inflow port Rin into which ink supplied from the upstream side flows is formed in each of the common liquid chambers SR.

An opening portion 482A is formed in each of nozzle N in the pressure chamber substrate 482. The vibrating plate 483 is a flat plate member which is provided on the surface on a side opposite to the flow path substrate 481 in the pressure chamber substrate 482, and can be elastically deformed. A space interposed between the vibrating plate 483 and the flow path substrate 481 in the inside of each opening portion 482A of the pressure chamber substrate 482 functions as a pressure chamber (cavity) SC which is filled with ink supplied through the branching flow path 481B from the common liquid chamber SR. Each of the pressure chambers SC communicates with the nozzle N through the communicating flow path 481C of the flow path substrate 481.

The piezoelectric element 484 is formed in each nozzle N on the surface of the vibrating plate 483 on a side opposite to the pressure chamber substrate 482. Each of the piezoelectric elements 484 is a driving element in which a piezoelectric body is interposed between electrodes which face each other. When a driving signal is supplied, and the vibrating plate 483 vibrates due to deformation of the piezoelectric element 484, a pressure in the pressure chamber SC is changed, and ink in the pressure chamber SC is ejected from the nozzle N. The sealing body 486 protects the plurality of piezoelectric elements 484. In addition, the piezoelectric elements 484 are connected to the control device 12 by passing through a flexible print cable (FPC: flexible printed circuit), a chip on film (COF), or the like, (not illustrated).

The valve mechanism unit 41 and the flow path unit 42 function as a flow path structure which are provided with the liquid flow path D and the gas flow path A. The liquid flow path D is a flow path which communicates with the nozzle N. The gas flow path A communicates with the vacuum degassing chamber Q which performs degassing (operation of removing air bubbles from ink) of the liquid flow path D through a pressurizing chamber RC which controls the on-off valve B of the liquid flow path D, and gas permeable films MA, MB, and MC.

First, the on-off valve B and the pressurizing chamber RC will be described. An upstream side flow path R1 and a downstream side flow path R2 which configure a part of the liquid flow path D, and the pressurizing chamber RC which communicates with the gas flow path A are formed inside the valve mechanism unit 41. The upstream side flow path R1 is connected to a liquid press-sending mechanism 16 through the flow path component 46. The liquid press-sending mechanism 16 is a mechanism which supplies ink stored in the liquid container 14 to the liquid ejecting head 20 in a pressurized state (that is, sending in pressing manner). The on-off valve B is provided between the upstream side flow path R1 and the downstream side flow path R2, and a flexible film 71 is interposed between the downstream side flow path R2 and the pressurizing chamber RC.

The on-off valve B is a valve mechanism which opens or closes the liquid flow path D through which ink is supplied to the liquid ejecting unit 44. The on-off valve B is provided with a valve V. The valve V is provided between the upstream side flow path R1 and the downstream side flow path R2, and causes the upstream side flow path R1 and the downstream side flow path R2 to communicate (open state), or to be shut off (closed state). A spring Sp which urges the valve V in a direction in which the upstream side flow path R1 and the downstream side flow path R2 are shut off is provided in the valve V. Accordingly, when a force is not applied to the valve V, the upstream side flow path R1 and the downstream side flow path R2 are shut off. Meanwhile, when a force is applied to the valve V against the urging force of the spring Sp, and the valve V moves to a positive side in the Z direction, the upstream side flow path R1 and the downstream side flow path R2 communicate.

A bag-shaped body 73 is provided in the pressurizing chamber RC. The bag-shaped body 73 is a bag-shaped member formed of an elastic material such as rubber. The bag-shaped body 73 expands due to pressurizing of the gas flow path A, and contracts due to depressurizing thereof. The bag-shaped body 73 is connected to the pump 19 through the gas flow path A in the flow path component 46. The pump 19 according to the embodiment can perform pressurizing and depressurizing of the gas flow path A. The pump 19 may be configured of one pump which perform pressurizing and depressurizing, or may be configured by being divided into a pump for pressurizing and a pump for depressurizing. The pump 19 is driven by a sequence selected from the plurality of sequences according to an instruction from the control device 12. A pressurizing sequence in which gas is supplied to the gas flow path A, and a depressurizing sequence in which gas is absorbed from the gas flow path A are included in the plurality of sequences. The bag-shaped body 73 expands when the gas flow path A is pressurized (air is supplied) by the pressurizing sequence, and the bag-shaped body 73 contracts when the gas flow path A is depressurized (air is suctioned) by the depressurizing sequence.

In the state in which the bag-shaped body 73 contracts, in a case in which a pressure in the downstream side flow path R2 is maintained at a predetermined range, the valve V is pressed upward (negative side in Z direction) by being urged by the spring Sp, and the upstream side flow path R1 and the downstream side flow path R2 are shut off. Meanwhile, when a pressure in the downstream side flow path R2 decreases to a value lower than a predetermined threshold value due to ejecting of ink using the liquid ejecting unit 44, or suctioning from the outside, the valve V moves downward (positive side in Z direction) against an urging force of the spring Sp, and the upstream side flow path R1 and the downstream side flow path R2 communicate with each other. In addition, when the bag-shaped body 73 expands due to pressurizing by the pump 19, the flexible film 71 moves to a positive sided in the Z direction by pressing down the valve V, against an urging force of the spring Sp, due to pressing by the bag-shaped body 73. Accordingly, the valve V moves due to pressing of the flexible film 71, and the on-off valve B is opened. That is, it is possible to forcibly open the on-off valve B using pressurizing by the pump 19, regardless of highs and lows of a pressure in the downstream side flow path R2. When opening the on-off valve B by forcibly operating the flexible film 71 using pressurizing by the pump 19, it is a case in which the liquid ejecting head 20 is initially filled with ink (hereinafter, referred to as "initial filling"), a case in which ink is discharged from the nozzle N at a time of cleaning, or the like, for example.

Subsequently, the gas permeable films MA, MB, MC, and the vacuum degassing chamber Q will be described. A filter chamber RF and the vacuum degassing chamber Q which communicate with a vertical space RV are formed in the flow path unit 42. The vacuum degassing chamber Q is a space for removing air bubbles from ink by depressurizing a part of the liquid flow path D. The vacuum degassing chamber Q functions as a degassing space in which air bubbles (gas) removed from ink are temporarily stored. In addition, the vacuum degassing chamber Q is configured by being divided into two spaces of a depressurizing chamber and a degassing chamber which communicate with each other, and an on-off valve or a check valve may be provided at a communicating portion between the depressurizing chamber and the degassing chamber.

A filter F is provided in the filter chamber RF. The filter F is provided in the liquid ejecting unit 44 so as to go across the liquid flow path D, and collects air bubbles or foreign substances which are mixed into ink. Specifically, the filter F is provided so as to partition a space RF1 and a space RF2. The space RF1 on the upstream side communicates with the downstream side flow path R2 of the valve mechanism unit 41, and the space RF2 on the downstream side communicates with the vertical space RV.

The vertical space RV is a space for temporarily storing ink. An inflow port Vin into which ink passing through the filter F flows in from the space RF2, and an outflow path Vout from which ink flows out to the nozzle N side are formed in the vertical space RV. The inflow port Vin is located on the higher part in the vertical direction (negative side in Z direction) compared to the outflow port Vout. According to such a configuration, ink in the space RF2 flows into the vertical space RV through the inflow port Vin, and ink in the vertical space RV flows into the common liquid chamber SR through the outflow port Vout. The ink which flows into the common liquid chamber SR is supplied to each pressure chamber SC by passing through the opening portion 481A, and is ejected from each nozzle N.

The gas permeable films MA, MB, and MC are provided so as to partition a plurality of portions in the vacuum degassing chamber Q, and the liquid flow path D. However, a disposal position of the gas permeable film, and the number thereof are not limited to the example. For example, the gas permeable film may be provided at only one portion in the liquid flow path D (for example, portion MC of gas permeable film). The gas permeable film MA is interposed between the vertical space RV and the vacuum degassing chamber Q. The gas permeable film MB is interposed between the common liquid chamber SR and the vacuum degassing chamber Q. The gas permeable film MC is interposed between the space RF1 and the vacuum degassing chamber Q. The gas permeable films MA, MB, and MC are gas permeable films (gas-liquid separating film) in which gas (air) is permeable; however, liquid such as ink is not permeable, and for example, the gas permeable film is formed of a well-known high polymer material, for example. Air bubbles collected in the filter F are discharged to the vacuum degassing chamber Q by permeating the gas permeable film MC, and are removed from ink. In addition, also air bubbles which pass through the filter F also flow into the vertical space RV through the inflow port Vin from the space RF1, and flows into the vertical space RV. Accordingly, air bubbles which flow into the vertical space RV are also discharged to the vacuum degassing chamber Q by permeating the gas permeable film MA.

In addition, a discharging port R out is formed in the common liquid chamber SR. The discharging port Rout is a flow path formed on a ceiling face 49 of the common liquid chamber SR. The ceiling face 49 of the common liquid chamber SR is an inclined face which becomes high from an inflow port Rin side to the discharging port Rout side. Accordingly, air bubbles which enter from the inflow port Rin are also derived to the discharging port Rout side, and are discharged to the vacuum degassing chamber Q by permeating the gas permeable film MB.

Since the vacuum degassing chamber Q communicates with the gas flow path A, the vacuum degassing chamber Q is depressurized when the gas flow path A is depressurized by the pump 19. When the vacuum degassing chamber Q is depressurized, air bubbles in the liquid flow path D pass through the gas permeable films MA, MA, and MC. The gas which moved to the vacuum degassing chamber Q by passing through the gas permeable films MA, MA, and MC are discharged to the outside of the apparatus through the gas flow path A. In this manner, air bubbles are removed from the liquid flow path D.

The liquid flow path D in the embodiment includes a discharging path 76 which passes through the valve mechanism unit 41 from the flow path unit 42, and reaches the inside of the flow path component 46. The discharging path 76 is a path which communicates with an internal flow path of the flow path unit 42 (specifically, flow path for supplying ink to liquid ejecting unit 44). Specifically, the discharging path 76 communicates with the discharging port Rout of the common liquid chamber SR in each liquid ejecting unit 44, and the vertical space RV.

An end portion on the valve mechanism unit 41 side of the discharging path 76 is connected to the obturator valve 78. The obturator valve 78 is installed at an arbitrary position; however, in FIG. 3, a configuration in which the obturator valve 78 is installed in the flow path component 46 is exemplified. The obturator valve 78 is a valve mechanism which can close the discharging path 76 in a normal state (normally closed), and can temporarily open the discharging path 76 to the air.

As described above, in the liquid ejecting head 20 according to the embodiment, the gas flow path A communicates with the pressurizing chamber RC and the vacuum degassing chamber Q. Accordingly, it is possible to open the on-off valve B by expanding the bag-shaped body 73 of the pressurizing chamber RC, by pressurizing the gas flow path A using the pump 19, and remove gas from the liquid flow path D by depressurizing the vacuum degassing chamber Q, by depressurizing the gas flow path A using the pump 19.

Meanwhile, as in the embodiment, in the configuration in which the gas flow path A is used as the pressurizing chamber RC and the vacuum degassing chamber Q, there is a case in which the gas flow path A is switched from a depressurized state to a pressurized state. However, when the gas flow path A is transferred from a depressurized state to a pressurized state, there is a problem in that, the lower the pressure in depressurizing, it takes time in transferring from a depressurized state to a pressurized state, and a response (response of flexible film 71) of a pressure change decreases.

Therefore, in the first embodiment, it is set so that the pump 19 can be driven using a depressurizing sequence selected by the control device 12 from the plurality of depressurizing sequences which depressurizes the vacuum degassing chamber Q so that an average pressure of the vacuum degassing chamber Q is different. The depressurizing sequence here is a sequence from a start of driving of the pump 19 to a reaching pressure as a target, and from the reaching pressure to a start of the subsequent driving of the pump 19. The average pressure of the vacuum degassing chamber Q is an average value of a pressure from the above described target reaching pressure to a start of the subsequent driving of the pump 19 in the depressurizing sequence.

According to such a configuration, it is possible to change the average pressure of the vacuum degassing chamber Q by driving the pump 19, by changing a sequence to be selected from the plurality of depressurizing sequences. Accordingly, it is possible to perform pressurizing from a depressurized state in which a pressure of the gas flow path A is high, by switch to a depressurizing sequence in which an average pressure of the vacuum degassing chamber Q is high to a pressurizing sequence. In this manner, it is possible to improve a response (response of flexible film 71) in a pressure change when the gas flow path A is transferred from a depressurized state to a pressurized state. In addition, since it is possible to change the average pressure of the vacuum degassing chamber Q, when a driving time of the pump is changed by selecting the depressurizing sequence, a lifespan of the pump 19 can be lengthened. In addition, it is possible to increase a discharging speed of air bubbles to be discharged by passing through the gas permeable films MA, MB, and MC, by selecting a depressurizing sequence in which the average pressure of the vacuum degassing chamber Q is low.

Figure 4:
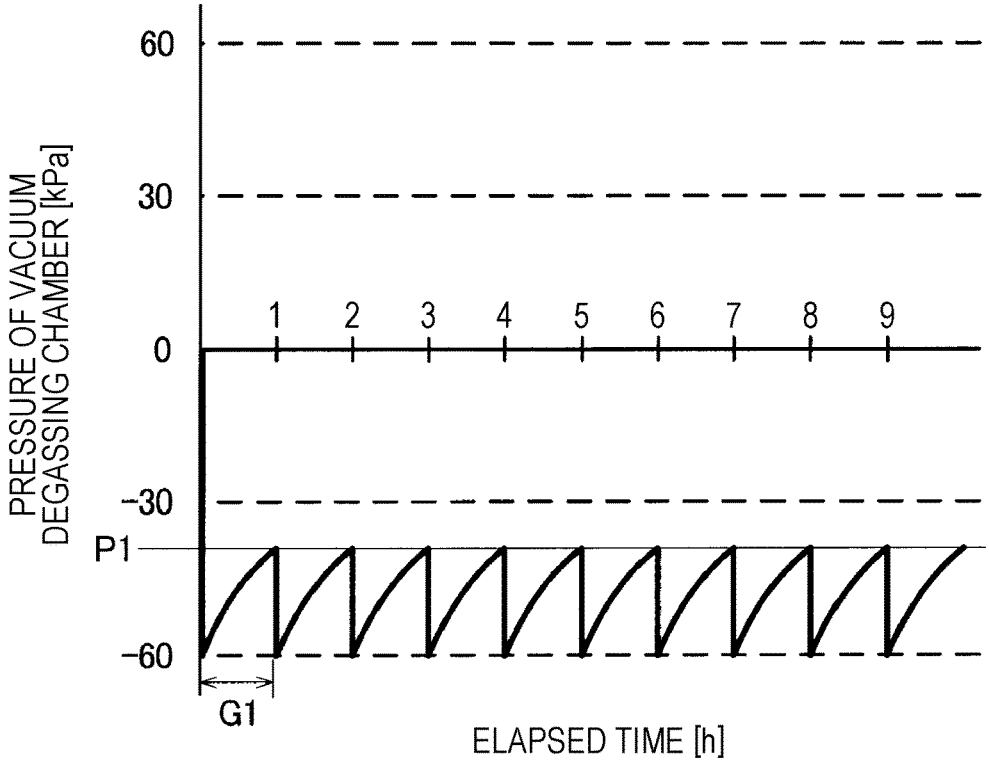
FIG. 4 is a diagram which illustrates a depressurizing sequence (first depressurizing sequence) according to the first embodiment.
Figure 5:
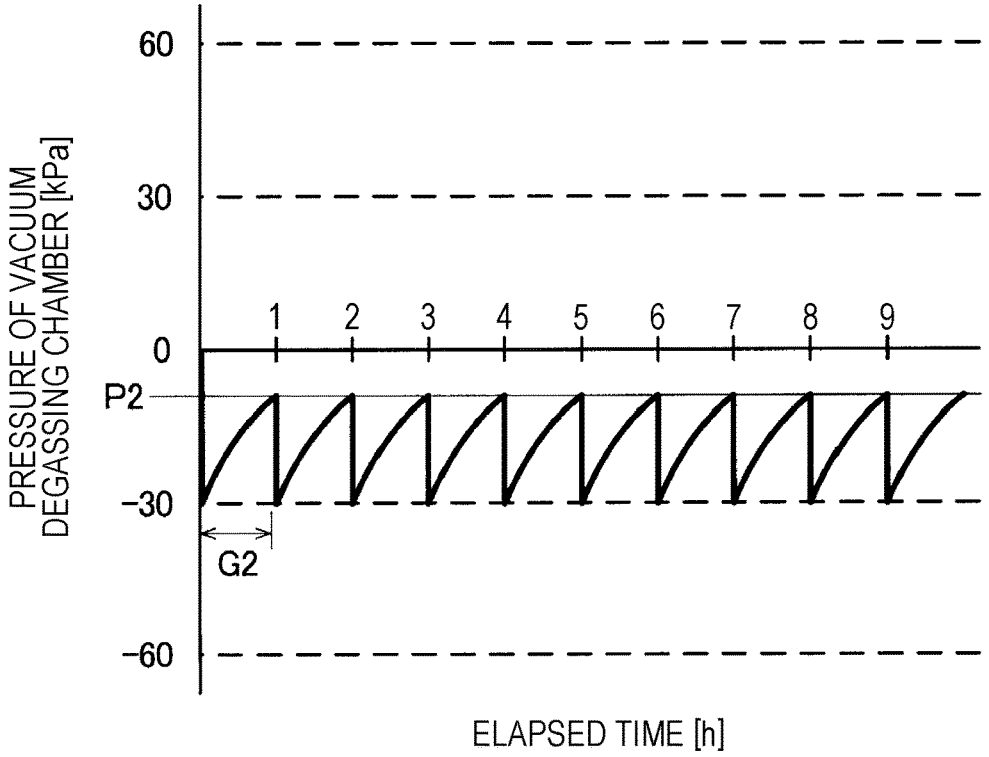
FIG. 5 is a diagram which illustrates a depressurizing sequence (second depressurizing sequence) according to the first embodiment.

Hereinafter, a specific example of the plurality of depressurizing sequences in the first embodiment will be described. Here, a depressurizing sequence G1 (first depressurizing sequence) and a depressurizing sequence G2 (second depressurizing sequence) in which average pressures of the vacuum degassing chamber Q are different will be exemplified. However, the depressurizing sequences in which average pressures of the vacuum degassing chamber Q are different are not limited to the two exemplified depressurizing sequences, and may be three or more. FIG. 4 is a diagram which illustrates the depressurizing sequence G1, and FIG. 5 is a diagram which illustrates the depressurizing sequence G2. In FIGS. 4 and 5, the vertical axis denotes an elapsed time [h] in a unit of one hour, and the horizontal axis denotes a pressure [kPa] of the vacuum degassing chamber Q.

In the depressurizing sequences G1 and G2 in the embodiment, from a start of driving of the pump 19 to a reaching pressure as a target, and from the reaching pressure to a start of the subsequent driving of the pump 19 is set to one sequence, respectively. The depressurizing sequences G1 and G2 are repeated by a plurality of times in every predetermined time (one hour in FIGS. 4 and 5). In FIG. 4, P1 is the previous pressure in which the pump 19 is driven by the subsequent depressurizing sequence G1, and in FIG. 5, P2 is the previous pressure in which the pump 19 is driven by the subsequent depressurizing sequence G1.

In the first depressurizing sequence G1 in FIG. 4, a pressure of the vacuum degassing chamber Q is depressurized from zero by driving the pump 19. In addition, when the pressure of the vacuum degassing chamber Q reaches −60 kPa which is a reaching pressure as a target, the pump 19 is stopped. Thereafter, degassing of the vacuum degassing chamber Q is proceeded, and the pressure is gradually attenuated (rises), since gas flows into the vacuum degassing chamber Q. In addition, one hour after, the pump 19 is driven again using the second depressurizing sequence G1, and the vacuum degassing chamber is depressurized. FIG. 4 illustrates a sequence in which the depressurizing sequence G1 is repeated in every one hour. Accordingly, in the depressurizing sequence G1, the pump 19 is driven in every one hour in the sequence in FIG. 4. However, a timing for driving the pump 19 is not limited to the example.

In the first depressurizing sequence G2 in FIG. 5, a pressure of the vacuum degassing chamber Q is depressurized from zero by driving the pump 19. In addition, when the pressure of the vacuum degassing chamber Q reaches −30 kPa which is a reaching pressure as a target, the pump 19 is stopped. Thereafter, since degassing in the vacuum degassing chamber Q is proceeded, the pressure gradually rises. In addition, the pump 19 is driven again in the second depressurizing sequence G2 one hour after, and the vacuum degassing chamber is depressurized. FIG. 5 illustrates a sequence in which the depressurizing sequence G2 is repeated in every one hour. Accordingly, also in the sequence in FIG. 5, the pump 19 is driven in every one hour, similarly to the case in FIG. 4. However, a timing for driving the pump 19 is not limited to the example.

A reaching pressure (−60 kPa) as a target of the vacuum degassing chamber Q in the depressurizing sequence G1 in FIG. 4 is lower than the reaching pressure (−30 kPa) as a target of the vacuum degassing chamber Q by the depressurizing sequence G2 in FIG. 5. For this reason, the average pressure of the vacuum degassing chamber Q in FIG. 4, as the average pressure from the reaching pressure (−60 kPa) to P1 in FIG. 4 is lower than the average pressure of the vacuum degassing chamber Q in the depressurizing sequence G1, as the average pressure from the reaching pressure (−30 kPa) to P2 in FIG. 5. Accordingly, since a pressure of the vacuum degassing chamber Q in the depressurizing sequence G1 can be set to be lower than that in the depressurizing sequence G2, it is possible to increase a degassing speed. In this point, the depressurizing sequence G1 can be referred to as a high speed degassing sequence.

When changing the viewpoint, a reaching pressure as a target of the vacuum degassing chamber Q using the depressurizing sequence G2 in FIG. 5 is higher than a reaching pressure as a target of the vacuum degassing chamber Q using the depressurizing sequence G1 in FIG. 4. In addition, the average pressure of the vacuum degassing chamber Q of the depressurizing sequence G1 in FIG. 5 is higher than the average pressure of the vacuum degassing chamber Q in FIG. 4. Accordingly, since it is possible to make a pressure of the vacuum degassing chamber Q in the depressurizing sequence G2 higher than a pressure of the vacuum degassing chamber Q in depressurizing sequence G1, a load of the pump 19 can be reduced. In this point, the depressurizing sequence G2 can be referred to as a degassing sequence with a low load. In addition, the reaching pressure and the average pressure as targets of the vacuum degassing chamber Q are not limited to the example.

The average pressure of the vacuum degassing chamber Q using the depressurizing sequence G2 in FIG. 5 is a pressure higher than the average pressure of the vacuum degassing chamber Q using the depressurizing sequence G1 in FIG. 4. Accordingly, when switching from a depressurized state to a pressurized state, it is possible to transfer to the pressurized state in a short time when it is pressurizing from the depressurizing sequence G2, compared to pressurizing from the depressurizing sequence G1, and it is possible to increase a response of a pressure change. Accordingly, in the embodiment, it is possible to increase a response of a pressure change when transferring from a depressurized state to a pressurizing state, by switching from the depressurizing sequence G2 to a pressurizing sequence K.

Figure 6:
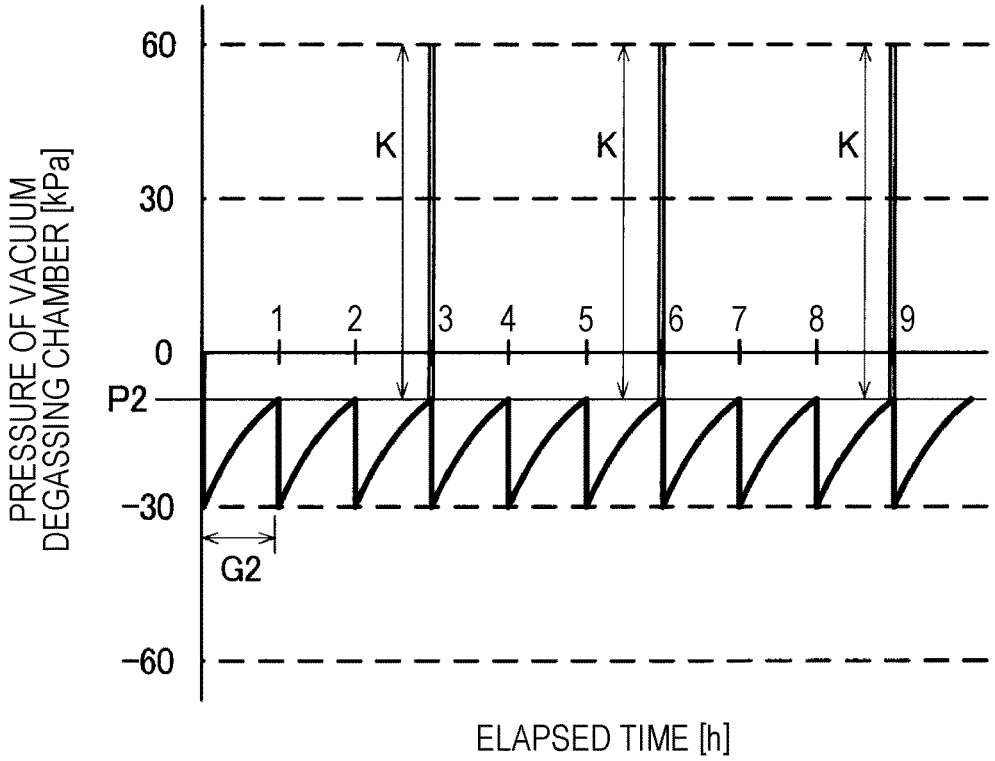
FIG. 6 is a diagram which illustrates sequence for driving a pump in the first embodiment.
Figure 7:
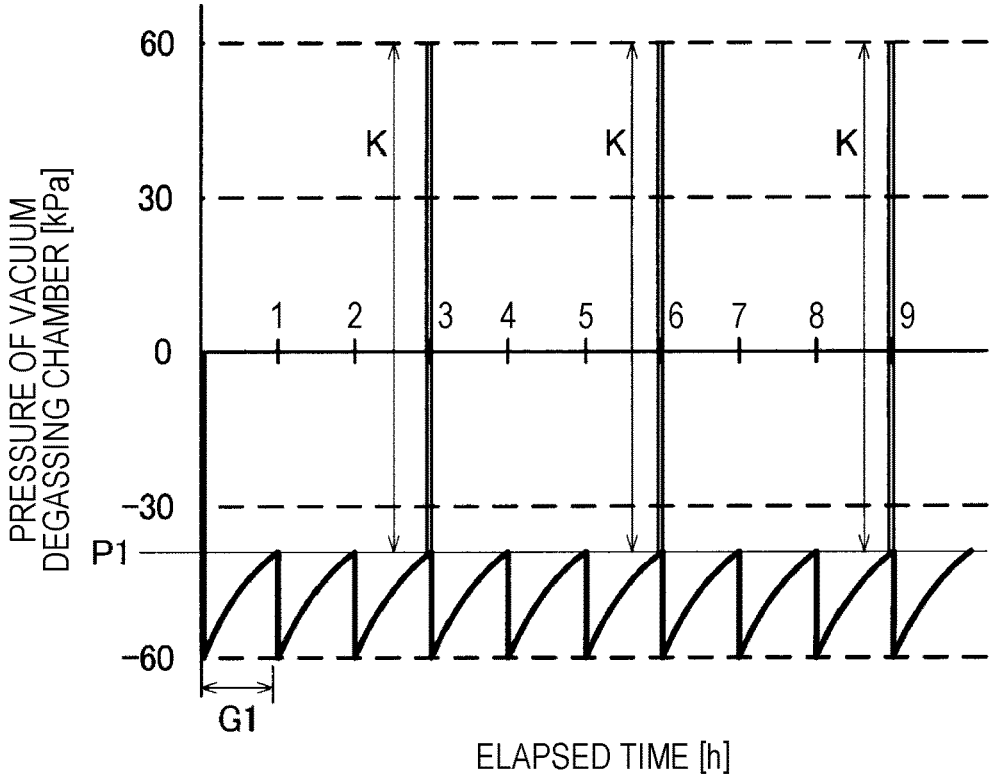
FIG. 7 is a diagram which illustrates a sequence for driving a pump in a comparison example.

Hereinafter, a case of performing such a pressurizing sequence K will be described in detail. FIG. 6 is a diagram which illustrates a sequence in the embodiment in which it is switched from the depressurizing sequence G1 to the pressurizing sequence K, and FIG. 7 is a diagram which illustrates a sequence in a comparison example in which it is switched from the depressurizing sequence G2 to a pressurizing sequence K'. In FIGS. 6 and 7, the vertical axis denotes an elapsed time [h] in a unit of one hour, and the horizontal axis denotes a pressure of the vacuum degassing chamber Q [kPa]. The pressurizing sequences K and K' in FIGS. 6 and 7 exemplify a case in which a reaching pressure as a target of the vacuum degassing chamber Q is 60 kPa. However, the reaching pressure as a target of the vacuum degassing chamber Q is not limited to the example.

The pressurizing sequences K and K' in FIGS. 6 and 7 are sequences in a case in which pressurizing up to a reaching pressure 60 kPa as a target is performed by driving the pump 19, after finishing the depressurizing sequences G1 and G2, respectively, and the pressurized state is returned to the original pressure. At this time, as in the comparison example in FIG. 7, in a case of switching from the depressurizing sequence G1 to the pressurizing sequence K', the pressurizing sequence K' is started from the pressure P1 which is lower than the pressure P2. In contrast to this, as in the embodiment in FIG. 6, in a case of switching from the depressurizing sequence G2 to the pressurizing sequence K, the pressurizing sequence K is started from the pressure P2 which is higher than P1. Accordingly, in the embodiment in FIG. 6, it is possible to increase a response in a pressure change when transferring from a depressurized state to a pressurized state compare to the comparison example in FIG. 7. In addition, a timing for performing pressurizing up to the reaching pressure 60 kPa as the target by driving the pump 19 may not after finishing the depressurizing sequences G1 and G2, and may be in the middle of the depressurizing sequences G1 and G2. Also in the case, since the average pressure of the vacuum degassing chamber Q using the depressurizing sequence G2 is higher than the average pressure of the vacuum degassing chamber Q using the depressurizing sequence G1, it is possible to increase a response in pressure change when transferring from a depressurized state to a pressurized state, by switching from the depressurizing sequence G2 to the pressurizing sequence K.

According to the liquid ejecting apparatus 10 in the embodiment, the control device 12 drives the pump 19 using a depressurizing sequence which is selected from the plurality of depressurizing sequences G1 and G2 which depressurize the vacuum degassing chamber Q, and the pressurizing sequence K in which the pressurizing chamber RC is pressurized so that an average pressure of the vacuum degassing chamber Q becomes different. In this manner, it is possible to change the average pressure (or reaching pressure) of the vacuum degassing chamber Q, when the control device 12 drives the pump 19 by changing a sequence to be selected from the two depressurizing sequences G1 and G2. Accordingly, since it is possible to perform pressurizing from the depressurized state in which a pressure is high by switching from the depressurizing sequence G2 to the pressurizing sequence K, it is possible to increase a response in pressure change when transferring from a depressurized state to a pressurized state. In addition, it is possible to suppress a power consumption of the pump 19, and lengthen a lifespan of the pump 19 when the control device 12 selects the depressurizing sequence G2. In addition, it is possible to increase a degassing speed in the liquid flow path D, when the control device 12 selects the depressurizing sequence G1.

In addition, a configuration in which the depressurizing sequences G1 and G2 are selected according to a timing for pressurizing the flexible film 71 may be adopted. In this manner, it is possible to separately use the depressurizing sequences G1 and G2 according to a timing for pressurizing the flexible film 71. For example, the control device 12 can increase a degassing speed by selecting the depressurizing sequence G1 in a case in which the flexible film 71 is not pressurized. In addition, the control device 12 can increase a response of the flexible film 71 when transferring from a depressurized state to a pressurized state by selecting the depressurizing sequence G2 before executing the pressurizing sequence K, at a timing for pressurizing the flexible film 71.

In addition, the depressurizing sequences G1 and G2 may be selected according to an amount of air bubbles in the liquid flow path D. In this manner, it is possible to separately use the depressurizing sequences G1 and G2 according to an amount of air bubbles in the liquid flow path D. For example, the control device 12 detects an amount of air bubbles in the liquid flow path D using a sensor (not illustrated) which detects a speed or a pressure of ink, and the depressurizing sequences G1 and G2 are selected according to the detected amount of air bubbles. According to the configuration, for example, the control device 12 selects the depressurizing sequence G2 in which a pressure of the gas flow path A is high, when an amount of air bubbles in the liquid flow path D is the predetermined amount or less. In this manner, since it is possible to suppress a power consumption of the pump 19, a lifespan of the pump 19 can be lengthened. On the other hand, when an amount of air bubbles in the liquid flow path D exceeds a predetermined amount, the control device 12 selects the depressurizing sequence G1 in which a pressure in the gas flow path A is low. In this manner, it is possible to increase a discharging speed of air bubbles when there are many air bubbles such as an initial filling time of ink, for example.

In addition, the depressurizing sequences G1 and G2 may be selected according to a driving time of the pump 19. In this manner, it is possible to separately use the depressurizing sequences G1 and G2 according to a driving time of the pump 19. For example, the control device 12 obtains a driving time of the pump 19, and selects the depressurizing sequence G1 in which a pressure in the gas flow path A is low, when the driving time of the pump 19 is a predetermined time or less. On the other hand, the control device 12 selects the depressurizing sequence G2 in which a pressure in the gas flow path A is high, when the driving time of the pump 19 exceeds the predetermined time. In this manner, it is possible to lengthen a lifespan of the pump 19 by separately using the depressurizing sequences G1 and G2.

In addition, according to the pressurizing sequence K in the embodiment, it is possible to discharge ink from the nozzle N by reducing a volume of the liquid flow path D, by bending the flexible film 71 of the pressurizing chamber RC. In this manner, it is possible to discharge thickened liquid from the nozzle N using the pressurizing sequence K, or it is also possible to clean an ejecting face using a blade, after causing paper dust, a contaminant, or the like, to be attached, by discharging ink from the nozzle N. When performing such pressurizing, since it is possible to improve a response of the flexible film 71 by switching from the depressurizing sequence G2 in which a pressure in the gas flow path A is high to the pressurizing sequence K, an efficiency of discharging thickened ink from the nozzle N can be increased. In addition, in the pressurizing chamber RC in the embodiment, the case in which the bag-shaped body 73 is provided is exemplified; however, the flexible film 71 may be operated, using only a pressure of gas, without providing the bag-shaped body 73. In addition, the pressurizing chamber RC may have a configuration in which only the flexible film 71 is driven, without providing the on-off valve B.

Second Embodiment

Figure 8:
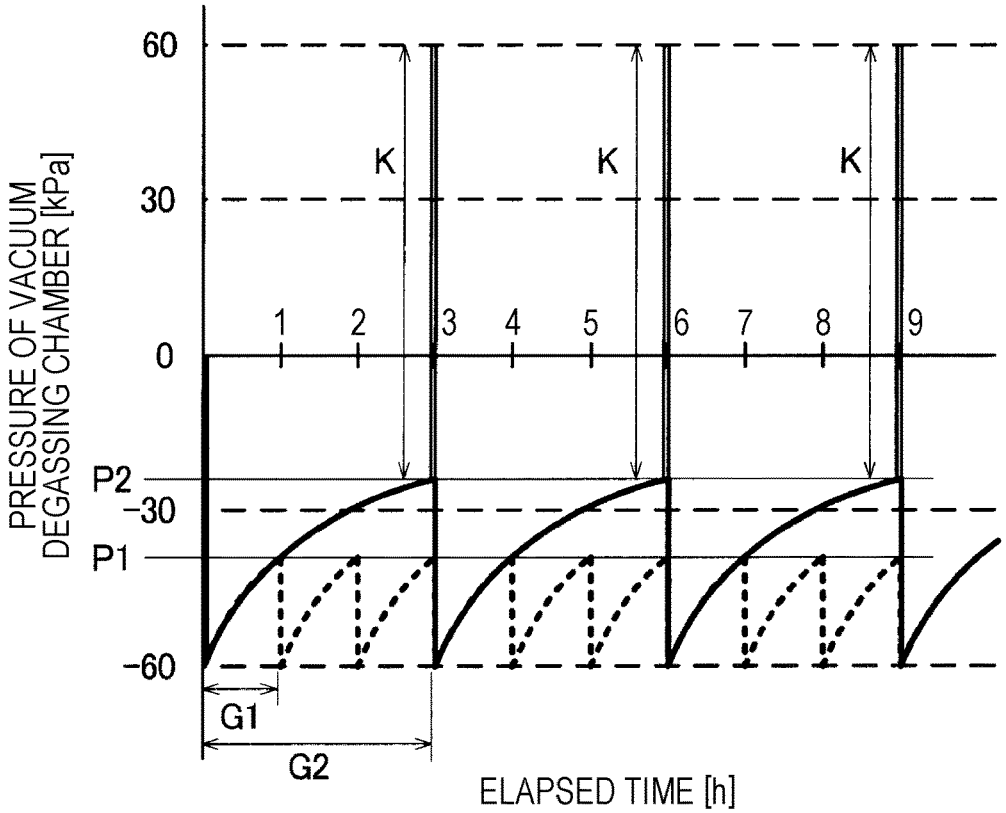
FIG. 8 is a diagram which illustrates a sequence for driving a pump in a second embodiment.

A second embodiment of the invention will be described. In each embodiment which will be exemplified in below, an element of which an operation or a function is the same as that in the first embodiment will be given the reference numeral which is used in the descriptions in the first embodiment, and detailed descriptions thereof will be appropriately omitted. FIG. 8 is a diagram which illustrates a sequence in which a pump 19 is driven in the second embodiment. In FIG. 8, a depressurizing sequence G1 is the same as that in FIG. 4, and a depressurizing sequence G2 is different from that in FIG. 5. In the depressurizing sequence G2 in FIG. 5, a case is exemplified, in which a cycle of driving the pump 19 is the same as that in the depressurizing sequence G1 in FIG. 4, and an average pressure of the vacuum degassing chamber Q is set to be different by making a reaching pressure as a target of the vacuum degassing chamber Q different. In contrast to this, in the depressurizing sequence G2 in FIG. 8, a case is exemplified, in which a reaching pressure (−60 kPa) as a target of the vacuum degassing chamber Q is the same as that in the depressurizing sequence G1, and an average pressure of the vacuum degassing chamber Q is set to be different by making a cycle of driving the pump 19 different.

Specifically, the pump 19 is driven in every one hour in the depressurizing sequence G1; however, in the depressurizing sequence G2 in FIG. 8, the pump 19 is driven every three hours. According to the configuration, it is possible to change a driving cycle of the pump 19, by driving the pump 19 by changing a sequence to be selected from the depressurizing sequences G1 and G2. In this manner, it is possible to change an average pressure of the vacuum degassing chamber Q by changing a driving cycle of the pump 19. Accordingly, since it is possible to switch from the depressurizing sequence G2 in which an average pressure of the vacuum degassing chamber Q is high to the pressurizing sequence K, pressurizing from a depressurized state in which a pressure of the gas flow path A is high can be performed. For this reason, it is possible to improve a response in pressure change, when the gas flow path A is transferred from a depressurized state to a pressurized state.

In addition, it is possible to change an amount of power consumption of the pump 19 by changing a driving cycle of the pump 19. The shorter the driving cycle of the pump 19, it is possible to realize an average pressure as a target even when a reaching pressure of the vacuum degassing chamber Q is high. For this reason, since it is possible to reduce a pressure resistance of the pump 19 or a flow path structure of the liquid ejecting apparatus 10, the flow path structure can be simplified. In FIG. 8, the depressurizing sequence G1 is denoted by being overlapped using a dotted line in order to be compared with the depressurizing sequence G2; however, it is possible to execute the depressurizing sequence G1 at a different timing from that in FIG. 8.

Third Embodiment

Figure 9:
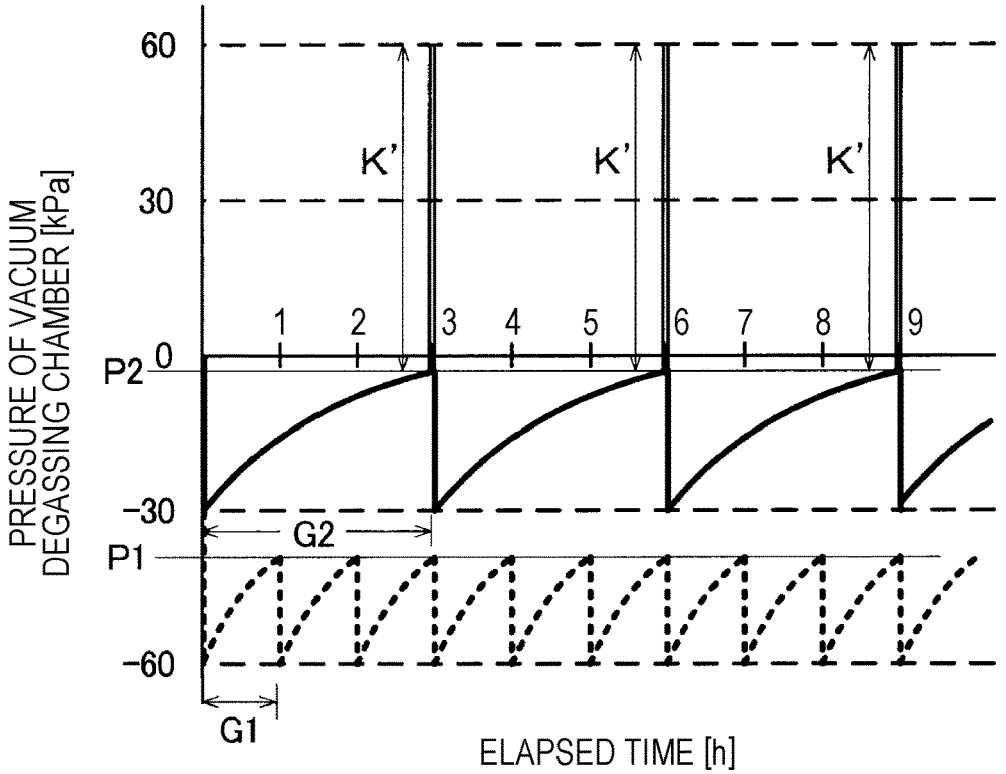
FIG. 9 is a diagram which illustrates a sequence for driving the pump in the third embodiment.

A third embodiment of the invention will be described. FIG. 9 is a diagram which illustrates a sequence in which the pump 19 is driven in the third embodiment. In the depressurizing sequence G2 in FIG. 9, a case is exemplified, in which an average pressure of the vacuum degassing chamber Q is set to be different, by also setting a reaching pressure (−60 kPa) as a target of the vacuum degassing chamber Q to be different from that in the pressurizing sequence G1, not only a cycle for driving the pump 19.

Specifically, in the depressurizing sequence G2 in FIG. 9, the pump 19 is driven in every three hours, and a reaching pressure as a target of the vacuum degassing chamber Q is −30 kPa. In this manner, by changing a driving cycle of the pump 19 and an average pressure of the vacuum degassing chamber Q, it is possible to change an average pressure of the vacuum degassing chamber Q. Accordingly, since it is possible to switch from the depressurizing sequence G2 in which the average pressure of the vacuum degassing chamber Q is high to the pressurizing sequence K, pressurizing from a depressurized state in which a pressure of the gas flow path A is high can be performed. In addition, in the depressurizing sequence G2 in FIG. 9, since a reaching pressure as a target of the vacuum degassing chamber Q is higher than that in the case in FIG. 8, it is possible to perform pressurizing from a depressurized state in which a pressure is higher than that in the case of FIG. 8. For this reason, in the depressurizing sequence G2 in FIG. 9, it is possible to increase a response in pressure change when the gas flow path A is transferred from a depressurized state to a pressurized state, compared to the case in FIG. 8. In addition, the shorter the driving cycle of the pump 19, it is possible to reduce a pressure resistance of the pump 19, or the flow path structure of the liquid ejecting apparatus 10, also in the depressurizing sequence G2 in FIG. 9, similarly to the case in FIG. 8, it is possible to make the flow path structure simple. In addition, in FIG. 9, the depressurizing sequence G1 is denoted by being overlapped using a dotted line in order to be compared with the depressurizing sequence G2; however, it is possible to execute the depressurizing sequence G1 at a different timing from that in FIG. 9.

Modification Example

Each of the above exemplified embodiments can be variously modified. A specific modification will be exemplified below. Two or more modifications which are arbitrarily selected from the following examples can be appropriately merged in a range of not being mutually contradictory.

(1) In the above described embodiment, a case is exemplified, in which the pump 19 is driven by a plurality of depressurizing sequences which depressurize the vacuum degassing chamber Q so that an average pressure of the vacuum degassing chamber Q becomes different; however, it is not limited to this. For example, the pump 19 may be driven by the plurality of depressurizing sequences which depressurize the vacuum degassing chamber Q so that a power consumption of the pump 19 is different. According to the configuration, it is possible to change an amount of power consumption of the pump 19, by driving the pump 19 by changing a sequence to be selected from the plurality of depressurizing sequences. It is also possible to change the average pressure of the vacuum degassing chamber Q by changing the amount of power consumption of the pump 19. Accordingly, it is possible to perform pressurizing from a depressurized state in which a pressure of the gas flow path A is high, by switching from the depressurizing sequence in which the amount of power consumption of the pump 19 is small to the pressurizing sequence. In this manner, it is possible to improve a response in pressure change when the gas flow path A is transferred from a depressurized state to a pressurized state. In addition, since it is possible to change the amount of power consumption of the pump 19 by selecting a depressurizing sequence, a lifespan of the pump 19 can be lengthened.

(2) In the above described embodiment, a serial head in which the carriage 18 on which the liquid ejecting head 20 is mounted is repeatedly reciprocated along the X direction is exemplified; however, it is also possible to apply the invention to a line head in which the liquid ejecting heads 20 are arranged over the entire width of the medium 11.

(3) In the above described embodiment, a piezoelectric-type liquid ejecting head 20 in which a piezoelectric element which applies a mechanical vibration to the pressure chamber is used is exemplified; however, it is also possible to adopt a thermal-type liquid ejecting head in which a heating element which generates air bubbles in the inside of the pressure chamber using heating is used.

(4) The liquid ejecting apparatus exemplified in the above described embodiment can be adopted in various devices such as a facsimile or a copier, in addition to devices which are exclusively used in printing. As a matter of course, a use of the liquid ejecting apparatus in the invention is not limited to printing. For example, a liquid ejecting apparatus which ejects a solution of a coloring material is used as a manufacturing device for forming a color filter of a liquid crystal display device. In addition, a liquid ejecting apparatus which ejects a solution of a conductive material is used as a manufacturing device for forming wiring or an electrode of a wiring substrate.

What is claimed is:

1. A liquid ejecting apparatus comprising:

a liquid flow path which communicates with a nozzle configured to eject liquid;

a vacuum degassing chamber for removing air bubbles from liquid by depressurizing a part of the liquid flow path;

a pressurizing chamber for pressurizing a part of the liquid flow path;

a pump for depressurizing the vacuum degassing chamber and pressurizing the pressurizing chamber;

a gas flow path which communicates with the vacuum degassing chamber, the pressurizing chamber, and the pump, and a controller configured to drive of the pump;

wherein the controller drives the pump by a sequence selected from a plurality of sequences, wherein the plurality of sequences include a plurality of depressurizing sequences in which the vacuum degassing chamber is depressurized so that an average pressure of the vacuum degassing chamber becomes different, and a pressurizing sequence in which the pressurizing chamber is pressurized, wherein (i) both of the vacuum degassing chamber and the pressurizing chamber vacuum gas into the gas flow path in the plurality of depressurizing sequences, and (ii) both of the vacuum degassing chamber and the pressurizing chamber are supplied gas from the gas flow path in the pressurizing sequence, and wherein liquid is discharged from a nozzle by reducing a volume of the liquid flow path, by bending a flexible film of the pressurizing chamber using the pressurizing sequence.

2. The liquid ejecting apparatus according to claim 1, wherein in the plurality of depressurizing sequences, a reaching pressure as a target of the vacuum degassing chamber using the pump is different.

3. The liquid ejecting apparatus according to claim 1, wherein driving cycles of the pump are different in the plurality of depressurizing sequences.

4. The liquid ejecting apparatus according to claim 1, wherein the pressurizing chamber is provided with a flexible film which bends due to pressurizing by the pressurizing sequence, and wherein the plurality of depressurizing sequences are selected according to a timing of pressurizing the flexible film.

5. The liquid ejecting apparatus according to claim 1, wherein the plurality of sequences is selected according to an amount of air bubbles in the liquid flow path.

6. The liquid ejecting apparatus according to claim 1, wherein the plurality of depressurizing sequences are selected according to a driving time of the pump.

7. A liquid ejecting apparatus comprising:

a liquid flow path which communicates with a nozzle configured to eject liquid;

a vacuum degassing chamber for removing air bubbles from liquid by depressurizing a part of the liquid flow path;

a pressurizing chamber for pressurizing a part of the liquid flow path;

a pump for depressurizing the vacuum degassing chamber and pressurizing the pressurizing chamber;

a gas flow path which communicates with the vacuum degassing chamber, the pressurizing chamber, and the pump, and a controller configured to drive of the pump;

wherein the controller drives the pump by a sequence selected from a plurality of sequences, wherein the plurality of sequences include a plurality of depressurizing sequences in which the vacuum degassing chamber is depressurized so that driving cycles of the pump becomes different, and a pressurizing sequence in which the pressurizing chamber is pressurized, wherein (i) both of the vacuum degassing chamber and the pressurizing chamber vacuum gas into the gas flow path in the plurality of depressurizing sequences, and (ii) both of the vacuum degassing chamber and the pressurizing chamber are supplied gas from the gas flow path in the pressurizing sequence, and wherein liquid is discharged from a nozzle by reducing a volume of the liquid flow path, by bending a flexible film of the pressurizing chamber using the pressurizing sequence.

8. The liquid ejecting apparatus according to claim 7, wherein the plurality of depressurizing sequences are selected according to an amount of air bubbles in the liquid flow path.

9. The liquid ejecting apparatus according to claim 7, wherein the plurality of depressurizing sequences are selected according to a driving time of the pump.

10. A liquid ejecting apparatus comprising:

a liquid flow path which communicates with a nozzle configured to eject liquid;

a vacuum degassing chamber for removing air bubbles from liquid by depressurizing a part of the liquid flow path;

a pressurizing chamber for pressurizing a part of the liquid flow path;

a pump for depressurizing the vacuum degassing chamber and pressurizing the pressurizing chamber;

a gas flow path which communicates with the vacuum degassing chamber, the pressurizing chamber, and the pump; and a controller configured to drive of the pump, wherein the controller drives the pump by a sequence which is selected from a plurality of sequences, and wherein the plurality of sequences include a plurality of depressurizing sequences in which the vacuum degassing chamber is depressurized so that a power consumption of the pump becomes different, and a pressurizing sequence in which the pressurizing chamber is pressurized, wherein (i) both of the vacuum degassing chamber and the pressurizing chamber vacuum gas into the gas flow path in the plurality of depressurizing sequences, and (ii) both of the vacuum degassing chamber and the pressurizing chamber are supplied gas from the gas flow path in the pressurizing sequence, and wherein liquid is discharged from a nozzle by reducing a volume of the liquid flow path, by bending a flexible film of the pressurizing chamber using the pressurizing sequence.

* * * * *